US008943857B2

(12) United States Patent
Kappler et al.

(10) Patent No.: US 8,943,857 B2
(45) Date of Patent: Feb. 3, 2015

(54) CLOTHES WASHER DEMAND RESPONSE BY DUTY CYCLING THE HEATER AND/OR THE MECHANICAL ACTION

(75) Inventors: Jerrod Aaron Kappler, Louisville, KY (US); Michael F. Finch, Louisville, KY (US); Steven Keith Root, Louisville, KY (US); Daniel S. Frazer, West Chester, OH (US); Chad Michael Helms, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/899,951

(22) Filed: Oct. 7, 2010

(65) Prior Publication Data

US 2011/0061176 A1 Mar. 17, 2011

Related U.S. Application Data

(63) Continuation-in-part of application No. 12/559,751, filed on Sep. 15, 2009.

(51) Int. Cl.
*D06F 33/02* (2006.01)
*D06F 39/00* (2006.01)

(52) U.S. Cl.
CPC ..... *D06F 39/006* (2013.01); *D06F 33/02* (2013.01)
USPC ..... 68/12.16; 68/12.21

(58) Field of Classification Search
USPC ..... 68/12.02, 12.12, 12.16, 12.21
See application file for complete search history.

(56) References Cited

U.S. PATENT DOCUMENTS

| | | | | |
|---|---|---|---|---|
| 2,545,054 | A | | 3/1951 | Stitz |
| 3,683,343 | A | | 8/1972 | Feldman et al. |
| 3,720,073 | A | | 3/1973 | McCarty |
| 4,048,812 | A | | 9/1977 | Thomason |
| 4,167,786 | A | | 9/1979 | Miller et al. |
| 4,190,756 | A | | 2/1980 | Foerstner |
| 4,216,658 | A | | 8/1980 | Baker et al. |
| 4,247,786 | A | * | 1/1981 | Hedges ..... 307/35 |
| 4,362,970 | A | | 12/1982 | Grady |

(Continued)

FOREIGN PATENT DOCUMENTS

| | | | |
|---|---|---|---|
| CN | 1692317 | A | 11/2005 |
| CN | 101013979 | A | 8/2007 |

(Continued)

OTHER PUBLICATIONS

PCT/US2009/056919 International Search Report.

(Continued)

*Primary Examiner* — Joseph L Perrin
(74) *Attorney, Agent, or Firm* — GE Global Patent Operation; Marc A. Vivenzio

(57) ABSTRACT

A clothes washer is provided comprising one or more power consuming functions and a controller in signal communication with an associated utility. The controller can receive and process a signal from the associated utility indicative of current state of an associated utility. The controller operates the clothes washer in one of a plurality of operating modes, including at least a normal operating mode and an energy savings mode in response to the received signal. The controller is configured to change the power consuming functions by changing the duty cycling profile of the heater and/or mechanical action of the basket in the energy savings mode.

16 Claims, 7 Drawing Sheets

(56) References Cited

U.S. PATENT DOCUMENTS 4,454,509 A 6/1984 Buennagel et al.
4,637,219 A 1/1987 Grose
4,659,943 A 4/1987 Virant
4,718,403 A 1/1988 McCall
4,731,547 A 3/1988 Alenduff et al.
4,841,281 A 6/1989 Melvin, Jr.
4,903,502 A 2/1990 Hanson et al.
4,926,837 A 5/1990 Parker et al.
4,998,024 A 3/1991 Kirk et al.
5,040,724 A 8/1991 Brinkruff et al.
5,137,041 A 8/1992 Hall et al.
5,183,998 A 2/1993 Hoffman et al.
5,220,807 A 6/1993 Bourne et al.
5,224,355 A 7/1993 So et al.
5,230,467 A 7/1993 Kubsch et al.
5,289,362 A 2/1994 Liebl et al.
5,408,578 A 4/1995 Bolivar
5,430,430 A 7/1995 Gilbert
5,451,843 A 9/1995 Kahn et al.
5,462,225 A 10/1995 Massara et al.
5,479,157 A 12/1995 Suman et al.
5,479,558 A 12/1995 White et al.
5,481,140 A 1/1996 Maruyama et al.
5,488,565 A 1/1996 Kennon et al.
5,495,551 A 2/1996 Robinson et al.
5,504,306 A 4/1996 Russell et al.
5,505,377 A 4/1996 Weiss
5,515,692 A 5/1996 Sterber et al.
5,574,979 A 11/1996 West
5,581,132 A 12/1996 Chadwick
5,635,895 A 6/1997 Murr
5,706,191 A 1/1998 Bassett et al.
5,761,083 A 6/1998 Brown et al.
5,805,856 A 9/1998 Hanson
5,816,491 A 10/1998 Berkeley et al.
5,866,880 A 2/1999 Seitz et al.
5,874,902 A 2/1999 Heinrich et al.
5,880,536 A 3/1999 Mardirossian
5,883,802 A 3/1999 Harris
5,886,647 A 3/1999 Badger et al.
5,926,776 A 7/1999 Glorioso et al.
5,937,942 A 8/1999 Bias et al.
5,956,462 A 9/1999 Langford
6,018,150 A 1/2000 Maher
6,026,651 A 2/2000 Sandelman
6,080,971 A 6/2000 Seitz
6,118,099 A 9/2000 Lake
6,144,161 A 11/2000 Kimmich et al.
6,179,213 B1 1/2001 Gibino et al.
6,185,483 B1 2/2001 Drees
6,229,433 B1 5/2001 Rye et al.
6,246,831 B1 6/2001 Seitz et al.
6,380,866 B1 4/2002 Sizer et al.
6,400,103 B1 6/2002 Adamson
6,480,753 B1 11/2002 Calder et al.
6,489,597 B1 12/2002 Hornung
6,553,595 B1 * 4/2003 Bruntz et al. ..... 8/158
6,631,622 B1 10/2003 Ghent et al.
6,694,753 B1 2/2004 Lanz et al.
6,694,927 B1 2/2004 Pouchak et al.
6,704,401 B2 3/2004 Piepho et al.
6,778,868 B2 8/2004 Imamura et al.
6,784,872 B1 8/2004 Matsui et al.
6,806,446 B1 10/2004 Neale
6,817,195 B2 11/2004 Rafalovich et al.
6,828,695 B1 12/2004 Hansen
6,860,431 B2 3/2005 Jayadev
6,872,919 B2 3/2005 Wakefield et al.
6,873,876 B1 3/2005 Aisa
6,879,059 B2 4/2005 Sleva
6,904,385 B1 6/2005 Budike
6,922,598 B2 7/2005 Lim et al.
6,943,321 B2 9/2005 Carbone et al.
6,961,642 B2 11/2005 Horst
6,983,210 B2 1/2006 Matsubayashi et al.
7,010,363 B2 3/2006 Donnelly et al.
7,039,575 B2 5/2006 Juneau
7,043,380 B2 5/2006 Rodenberg et al.
7,053,790 B2 5/2006 Jang et al.
7,057,140 B2 6/2006 Pittman
7,069,090 B2 6/2006 Huffington et al.
7,082,380 B2 7/2006 Wiebe et al.
7,110,832 B2 * 9/2006 Ghent ..... 700/16
7,155,305 B2 12/2006 Hayes et al.
7,164,851 B2 1/2007 Sturm et al.
7,206,670 B2 4/2007 Pimputkar et al.
7,266,962 B2 9/2007 Montuoro et al.
7,274,973 B2 9/2007 Nichols et al.
7,274,975 B2 9/2007 Miller et al.
7,368,686 B2 5/2008 Etheredge et al.
7,372,002 B2 5/2008 Nakamura et al.
7,420,140 B2 9/2008 Lenhart et al.
7,420,293 B2 9/2008 Donnelly et al.
7,446,646 B2 11/2008 Huomo
7,478,070 B2 1/2009 Fukui et al.
7,541,941 B2 6/2009 Bogolea et al.
7,561,977 B2 7/2009 Horst et al.
7,565,813 B2 7/2009 Pouchak
7,685,849 B2 3/2010 Worthington
7,720,035 B2 5/2010 Oh et al.
7,751,339 B2 7/2010 Melton et al.
7,783,390 B2 8/2010 Miller
7,919,729 B2 4/2011 Hsu
7,925,388 B2 4/2011 Ying
7,962,248 B2 6/2011 Flohr
7,991,513 B2 8/2011 Pitt
8,024,073 B2 9/2011 Imes et al.
8,027,752 B2 9/2011 Castaldo et al.
8,033,686 B2 10/2011 Recker et al.
8,094,037 B2 1/2012 Unger
8,185,252 B2 5/2012 Besore
8,190,302 B2 5/2012 Burt et al.
8,355,748 B2 1/2013 Abe et al.
8,367,984 B2 2/2013 Besore et al.
2001/0025349 A1 9/2001 Sharood et al.
2001/0048361 A1 12/2001 Mays et al.
2002/0024332 A1 2/2002 Gardner
2002/0071689 A1 6/2002 Miyamoto
2002/0125246 A1 9/2002 Cho et al.
2002/0175806 A1 11/2002 Marneweck et al.
2002/0196124 A1 12/2002 Howard et al.
2002/0198629 A1 12/2002 Ellis
2003/0036820 A1 * 2/2003 Yellepeddy et al. ..... 700/291
2003/0043845 A1 3/2003 Lim et al.
2003/0178894 A1 9/2003 Ghent
2003/0193405 A1 10/2003 Hunt et al.
2003/0194979 A1 10/2003 Richards et al.
2003/0233201 A1 * 12/2003 Horst et al. ..... 702/62
2004/0024483 A1 2/2004 Holcombe
2004/0034484 A1 2/2004 Solomita et al.
2004/0098171 A1 5/2004 Horst
2004/0100199 A1 5/2004 Yang
2004/0107510 A1 6/2004 Buckroyd et al.
2004/0112070 A1 6/2004 Schanin
2004/0117330 A1 6/2004 Ehlers et al.
2004/0118008 A1 6/2004 Jeong et al.
2004/0128266 A1 * 7/2004 Yellepeddy et al. ..... 705/412
2004/0133314 A1 7/2004 Ehlers et al.
2004/0139038 A1 7/2004 Ehlers et al.
2004/0254654 A1 12/2004 Donnelly et al.
2005/0011205 A1 1/2005 Holmes et al.
2005/0134469 A1 6/2005 Odorcic et al.
2005/0138929 A1 6/2005 Enis et al.
2005/0173401 A1 8/2005 Bakanowski et al.
2005/0184046 A1 8/2005 Sterling
2005/0190074 A1 9/2005 Cumeralto et al.
2006/0031180 A1 2/2006 Tamarkin et al.
2006/0036338 A1 2/2006 Harkcom et al.
2006/0068728 A1 3/2006 Ishidoshiro et al.
2006/0095164 A1 5/2006 Donnelly et al.
2006/0123807 A1 6/2006 Sullivan et al.
2006/0159043 A1 7/2006 Delp et al.
2006/0162973 A1 7/2006 Harris et al.
2006/0190139 A1 8/2006 Reaume et al.

(56) References Cited

U.S. PATENT DOCUMENTS

| | | | | |
|---|---|---|---|---|
| 2006/0208570 | A1 | 9/2006 | Christian et al. | |
| 2006/0259547 | A1 | 11/2006 | Bogatin et al. | |
| 2006/0272830 | A1 | 12/2006 | Fima et al. | |
| 2006/0276938 | A1 | 12/2006 | Miller | |
| 2006/0289436 | A1 | 12/2006 | Carbone et al. | |
| 2007/0005195 | A1 | 1/2007 | Pasquale et al. | |
| 2007/0008076 | A1 | 1/2007 | Rodgers et al. | |
| 2007/0030116 | A1 | 2/2007 | Feher | |
| 2007/0043478 | A1 | 2/2007 | Ehlers et al. | |
| 2007/0136217 | A1 | 6/2007 | Johnson et al. | |
| 2007/0151311 | A1 | 7/2007 | McAllister et al. | |
| 2007/0185675 | A1 | 8/2007 | Papamichael et al. | |
| 2007/0203860 | A1 | 8/2007 | Golden et al. | |
| 2007/0213880 | A1 | 9/2007 | Ehlers | |
| 2007/0220907 | A1* | 9/2007 | Ehlers | 62/126 |
| 2007/0229236 | A1 | 10/2007 | Mercer et al. | |
| 2007/0271006 | A1 | 11/2007 | Golden et al. | |
| 2007/0276547 | A1 | 11/2007 | Miller | |
| 2008/0029081 | A1 | 2/2008 | Gagas et al. | |
| 2008/0034768 | A1 | 2/2008 | Pimentel et al. | |
| 2008/0083729 | A1 | 4/2008 | Etheredge et al. | |
| 2008/0106147 | A1* | 5/2008 | Caggiano et al. | 307/39 |
| 2008/0120790 | A1 | 5/2008 | Ashrafzadeh | |
| 2008/0122585 | A1 | 5/2008 | Castaldo et al. | |
| 2008/0136581 | A1 | 6/2008 | Heilman et al. | |
| 2008/0144550 | A1 | 6/2008 | Makhlouf et al. | |
| 2008/0167756 | A1 | 7/2008 | Golden et al. | |
| 2008/0167931 | A1 | 7/2008 | Gerstemeier et al. | |
| 2008/0172312 | A1 | 7/2008 | Synesiou et al. | |
| 2008/0177678 | A1 | 7/2008 | Di Martini et al. | |
| 2008/0179052 | A1 | 7/2008 | Kates | |
| 2008/0204240 | A1 | 8/2008 | Hilgers et al. | |
| 2008/0215263 | A1 | 9/2008 | Flohr | |
| 2008/0258633 | A1 | 10/2008 | Voysey | |
| 2008/0272934 | A1 | 11/2008 | Wang et al. | |
| 2008/0277487 | A1 | 11/2008 | Mueller et al. | |
| 2009/0006878 | A1 | 1/2009 | Borghetti et al. | |
| 2009/0038369 | A1 | 2/2009 | Vondras | |
| 2009/0063257 | A1 | 3/2009 | Zak et al. | |
| 2009/0105888 | A1 | 4/2009 | Flohr et al. | |
| 2009/0146838 | A1 | 6/2009 | Katz | |
| 2009/0171862 | A1 | 7/2009 | Harrod et al. | |
| 2009/0235675 | A1 | 9/2009 | Chang et al. | |
| 2009/0240381 | A1 | 9/2009 | Lane | |
| 2009/0254396 | A1 | 10/2009 | Metcalfe | |
| 2009/0326728 | A1 | 12/2009 | Chrisop et al. | |
| 2010/0017242 | A1 | 1/2010 | Hamilton et al. | |
| 2010/0070091 | A1 | 3/2010 | Watson et al. | |
| 2010/0092625 | A1 | 4/2010 | Finch et al. | |
| 2010/0131117 | A1 | 5/2010 | Mattiocco et al. | |
| 2010/0175719 | A1 | 7/2010 | Finch et al. | |
| 2010/0179708 | A1 | 7/2010 | Watson et al. | |
| 2010/0262963 | A1 | 10/2010 | Wassermann et al. | |
| 2010/0301774 | A1 | 12/2010 | Chemel et al. | |
| 2011/0001438 | A1 | 1/2011 | Chemel et al. | |
| 2011/0062142 | A1 | 3/2011 | Steurer | |
| 2011/0085287 | A1 | 4/2011 | Ebrom et al. | |
| 2011/0087382 | A1 | 4/2011 | Santacatterina et al. | |
| 2011/0095017 | A1 | 4/2011 | Steurer | |
| 2011/0106328 | A1 | 5/2011 | Zhou et al. | |
| 2011/0114627 | A1 | 5/2011 | Burt | |
| 2011/0123179 | A1 | 5/2011 | Roetker et al. | |
| 2011/0148390 | A1 | 6/2011 | Burt et al. | |
| 2011/0153106 | A1 | 6/2011 | Drake et al. | |
| 2011/0181114 | A1 | 7/2011 | Hodges et al. | |
| 2011/0290781 | A1 | 12/2011 | Burt et al. | |
| 2012/0054123 | A1 | 3/2012 | Broniak et al. | |

FOREIGN PATENT DOCUMENTS

| | | | |
|---|---|---|---|
| EP | 1496324 | A1 | 1/2005 |
| GB | 2105127 | A | 3/1983 |
| JP | 11313441 | A2 | 11/1999 |
| KR | 20060085711 | A | 7/2006 |
| WO | 86/00976 | A1 | 2/1986 |
| WO | 90/12261 | A1 | 10/1990 |
| WO | 98/48335 | A1 | 10/1998 |
| WO | 2007/060059 | A1 | 5/2007 |
| WO | 2007136456 | A2 | 11/2007 |

OTHER PUBLICATIONS

International Search Report from PCT Application No. PCT/US2009/056878, Nov. 17, 2009.

International Search Report from PCT Application No. PCT/US2009/056882, Nov. 4, 2009.

International Search Report from PCT Application No. PCT/US2009/056883, Oct. 26, 2009.

International Search Report from PCT Application No. PCT/US2009/056886, Nov. 5, 2009.

International Search Report from PCT Application No. PCT/US2009/056889, Nov. 10, 2009.

International Search Report from PCT Application No. PCT/US2009/056894, Nov. 13, 2009.

International Search Report from PCT Application No. PCT/US2009/056895, Nov. 9, 2009.

International Search Report from PCT Application No. PCT/US2009/056901, Nov. 10, 2009.

International Search Report from PCT Application No. PCT/US2009/056906, Nov. 10, 2009.

International Search Report from PCT Application No. PCT/US2009/056913, Nov. 10, 2009.

International Search Report from PCT Application No. PCT/US2009/056914, Nov. 2, 2009.

Search Report from EP Application No. 10153695.1, May 24, 2012.

Real-Time Feedback, Natural Resources Canada via website www.nrcan.gc.ca , 2008, http://oee.nrcan.gc.ca/publications/equipment/10918.

International Search Report from PCT Application No. PCT/US2009/056911, Mar. 10, 2010.

Lemay et al., An Integrated Architecture for Demand Response Communications and Control, University of Illinois Urbana-Champaign, Oct. 28, 2008.

Weisstein, Eric W. "At Least One.", From MathWorld—A Wolfram Web Resource. http://mathworld.wolfram.com/AtLeastOne.html, p. 1.

Search Report from CN Application No. 201010135268.8 dated Oct. 24, 2012.

* cited by examiner

CLOTHES WASHER DEMAND RESPONSE BY DUTY CYCLING THE HEATER AND/OR THE MECHANICAL ACTION

CROSS REFERENCE TO RELATED APPLICATIONS

The present application is a continuation-in-part application and claims priority from U.S. patent application Ser. No. 12/559,751, filed 15 Sep. 2009, which application is expressly incorporated herein by reference in its entirety.

BACKGROUND OF THE DISCLOSURE

This disclosure relates to energy management, and more particularly to energy management of household consumer appliances. The present disclosure finds particular application to energy management of a clothes washer appliance, and is also referred to as a clothes washer demand response.

Currently, utilities charge a flat rate. Increasing costs of fuel prices and high energy use during certain parts of the day make it highly likely that utilities will begin to require customers to pay a higher rate during peak demand. Accordingly, a potential cost savings is available to the homeowner by managing energy use of various household appliances, particularly during the peak demand periods. As is taught in the cross-referenced applications, a controller is configured to receive and process a signal, typically from a utility, indicative of a current cost of supplied energy. The controller is configured to change the operation of an appliance from a normal mode (e.g., when the demand and cost of the energy is lowest) to an energy savings mode (which can be at various levels, e.g., medium, high, critical). Thus, various responses are desired in an effort to reduce energy consumption and the associated cost.

More particularly, the parent application noted above generally teaches adjusting operation schedule, an operation delay, an operation adjustment and a select deactivation on at least one or more power consuming features or functions to reduce power consumption of the clothes washer in the energy savings mode. For example, the operation delay may include a delay in start time, an extension of time to a delayed start, pausing an existing cycle, and delaying a restart. A need exists for providing alternative courses of operation in a peak demand state where a consumer's flexibility and convenience is maximized during peak pricing events.

SUMMARY OF THE DISCLOSURE

A clothes washer includes at least one power consuming feature, including a heater assembly and a drum for tumbling/agitating laundry articles. A controller receives and processes a signal indicative of the current costs of supplied energy, and operates the clothes washer in one of a plurality of operating modes, including at least a normal mode and an energy savings mode based on the received signal. The controller is configured to modify a duty cycle of at least one of a heater assembly and movement of the drum in response to a signal representing the energy savings mode.

The controller intermittently operates the heater assembly during the energy savings mode and/or a tumbling and/or agitation action of the drum is modified.

In the energy savings mode, the tumbling/agitation action is modified in one or more of the following ways: the angular speed of rotation of the action becomes slower, the time between direction reversal of the action becomes longer, the angular rotation of action becomes smaller, and the angular rotation of action becomes larger.

In another arrangement, in the energy savings mode the tumbling/agitation action is intermittent.

The controller operates the heater assembly at a lower average power for an extended period of time when compared to operating the heater assembly at a higher average power in the normal mode.

The duration of on and off operations of the heater is dependent on the signal received.

In the energy savings mode, the drum may be moved intermittently, or the duration of dwell between rotation or agitation direction changes may change depending on the signal received.

The present disclosure reduces the average power used by the clothes washer during peak pricing times, and/or reduces overall energy used by the clothes washer and dryer during peak pricing times.

The present arrangement saves on costs, and adds convenience and flexibility for the consumer to deal with pricing events.

Still another benefit resides in completing the cycle faster while still shedding electrical load without having to pause or delay the cycle entirely.

Selected ones of the solutions are easy to execute, i.e., requiring only software to change the clothes washer operation as a result of received signals.

Still other benefits and advantages of this disclosure will become more apparent upon reading and understanding the following detailed description.

DETAILED DESCRIPTION OF THE PREFERRED EMBODIMENTS

Figure 1:
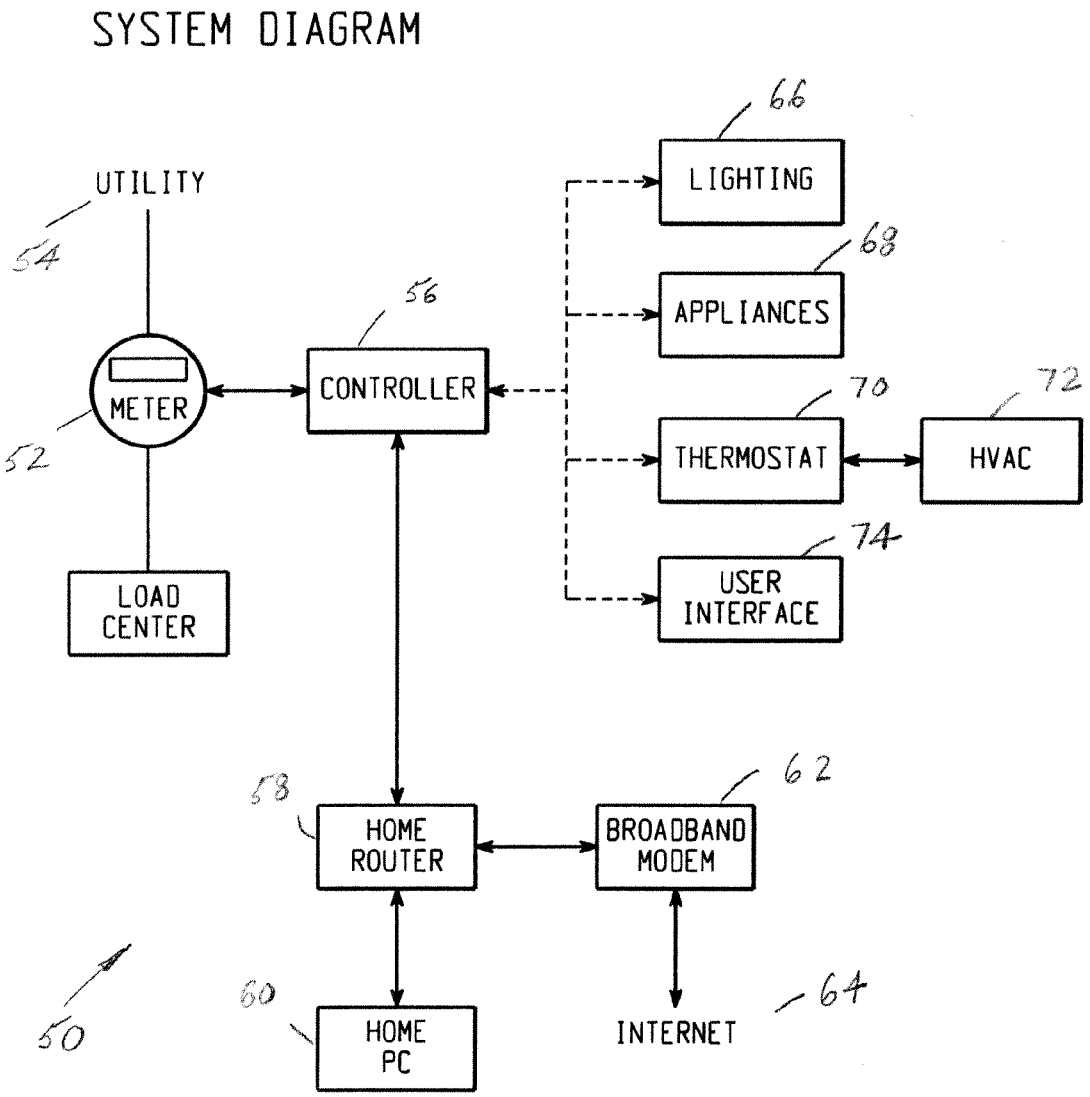
FIG. 1 is a schematic representation of an exemplary demand managed home including appliances such as a clothes washer.

FIG. 1 shows a general system diagram 50 of a utility meter 52 that communicates with utility 54 and a controller 56 that receives and processes a signal from the meter. The occurrence of peak demand and demand limit data may be communicated by the utility and through the meter to the controller. The demand limit can be set by the homeowner or consumer in some instances. Additionally, the homeowner can choose to force various modes in the appliance control based on the rate that the utility is charging. The controller may interact with a home router 58, home PC, broadband modem 62 or the internet 64. Preferably, the controller 56 is configured to control various items in the home, such as the lighting 66, one or more appliances 68 (including a clothes washer), the thermostat and HVAC 70, 72, respectively, and may include a user interface 74 that displays information for the homeowner and allows the homeowner to program the controller or override selected functions if so desired. This system is generally shown and described in commonly owned U.S. patent application Ser. No. 12/559,703, filed Sep. 15, 2009.

Figure 2:
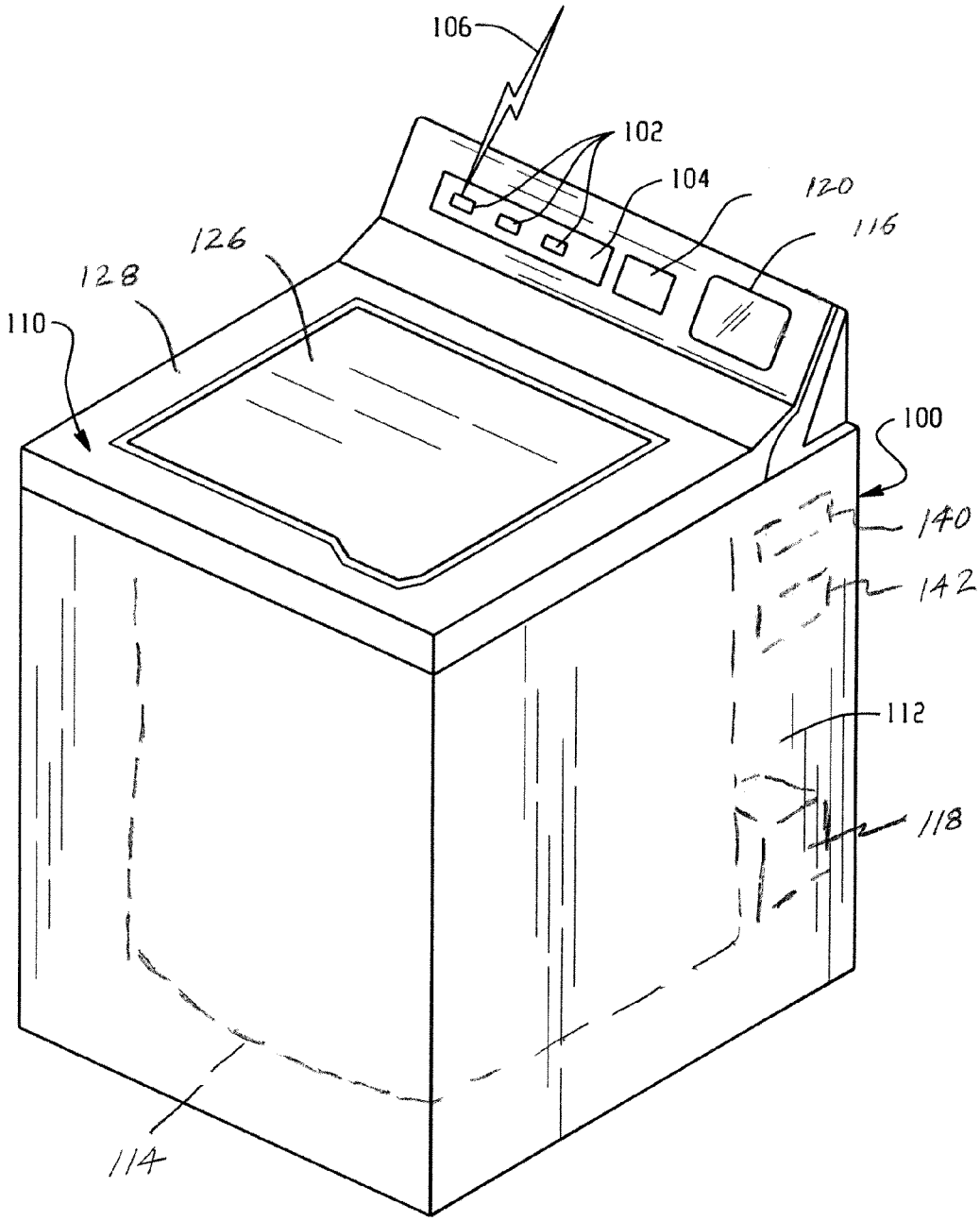
FIG. 2 is a perspective view of a clothes washer.

An exemplary embodiment of a demand managed appliance 100 is clothes washer 110 schematically illustrated in FIG. 2. The clothes washer 110 comprises at least one power consuming feature/function 102 and a controller 104 operatively associated with the power consuming feature/function. The controller 104 can include a micro computer on a printed circuit board which is programmed to selectively control the energization of the power consuming feature/function. The controller 104 is configured to receive and process a signal 106 indicative of a utility state, for example, availability and/or current cost of supplied energy. The energy signal may be generated by a utility provider, such as a power company, and can be transmitted via a power line, as a radio frequency signal, or by any other means for transmitting a signal when the utility provider desires to reduce demand for its resources. The cost can be indicative of the state of the demand for the utility's energy, for example a relatively high price or cost of supplied energy is typically associated with a peak demand state or period and a relative low price or cost is typically associated with an off-peak demand state or period.

The controller 104 can operate the clothes washer 110 in one of a plurality of operating modes, including a normal operating mode and an energy savings mode, in response to the received signal. Specifically, the clothes washer 110 can be operated in the normal mode in response to a signal indicating an off-peak demand state or period and can be operated in an energy savings mode in response to a signal indicating a peak demand state or period. As will be discussed in greater detail below, the controller 104 is configured to at least selectively adjust and/or disable the power consuming feature/function to reduce power consumption of the clothes washer 110 in the energy savings mode.

The clothes washer 110 generally includes an outer case or housing 112 and a control panel or user interface 116. The clothes washer further includes a lid pivotally mounted in the top wall. Though not shown in the drawings, clothes washer 110 includes within outer case 112, for example, a tub and/or wash basket 114 disposed for receiving clothes items to be washed, a drive system or motor 118 operatively connected to the controller and the basket 114 to tumble and/or agitate the wash load (also referred to herein as mechanical action) during wash and rinse cycles and spinning the basket during spin cycles, and a liquid distribution system comprising a water valve, for delivering water to the tub and basket and a pump for removing liquid from the tub, all of which may be of conventional design. Controller 104 is configured with a plurality of clothes washing algorithms preprogrammed in the memory to implement user selectable cycles for washing a variety of types and sizes of clothes loads. Each such cycle comprises a combination of pre-wash, wash, rinse, and spin sub-cycles. Each sub-cycle is a power consuming feature/function involving energization of a motor or other power consuming components. The amount of energy consumed by each cycle depends on the nature, number and duration of each of the sub-cycles comprising the cycle. The user interface 116 can include a display 120 and control buttons for enabling the user to make various operational selections. Instructions and selections are typically displayed on the display 120. The clothes washer further includes a door or lid 126 mounted within a top wall 128. Clothes washing algorithms can be preprogrammed in the memory accessed by the controller for many different types of cycles.

One response to a peak demand state is to delay operation, reschedule operation for a later start time, and/or alter one or more of selected functions/features in order to reduce energy demands. For example, clothes washers have the capacity to run at off-peak hours because demand is either not constant and/or the functions are such that immediate response is not necessary. However, a cost savings associated with reduced energy use during a peak demand period when energy costs are elevated must be evaluated with convenience for the consumer/homeowner. As one illustrative example, the clothes washer 110 that has been loaded during the daytime, i.e., typical peak demand period hours, can be programmed to delay operations for a later, albeit off-peak demand hours.

In order to reduce the peak energy consumed by a clothes washer, modifications and/or delays of individual clothes washer cycles can be adjusted in order to reduce the total and/or instantaneous energy consumed. Reducing total and/or instantaneous energy consumed also encompasses reducing the energy consumed at peak times and/or reducing the overall electricity demands during peak times and non-peak times.

In conjunction with the scheduling delays described above, or as separate operational changes, the following operation adjustments can be selected in order to reduce energy demands. The operation adjustments to be described hereinafter, can be implemented in conjunction with off-peak mode hours and/or can be implemented during on-peak mode hours. Associated with a clothes washer, the operational adjustments can include one or more of the following: a reduction in operating temperature (i.e. temperature set point adjustments) in one or more cycles, a disablement of one or more heaters in one or more cycles, reduction in power to one or more heaters, a switch from a selected cycle to a reduced power consumption cycle, a reduction in a duration of cycle time in one or more cycles, a disablement of one or more cycles, a skipping of one or more cycles, a reduction of water volume and/or water temperature in one or more cycles, and an adjustment to the wash additives (i.e., detergent, fabric softener, bleach, etc.) in one or more cycles. Illustratively, a switch from a selected cycle to a reduced power consumption cycle could include a change to the cycle definition when a command is received. For example, if a customer/user pushes "heavy duty wash" cycle, the selected cycle would then switch to a "regular" cycle, or the customer/user pushes "normal" cycle which would then switch to a "permanent press" cycle. As described, the switching is in response to lowering the energy demands from a selected cycle to a reduced power consumption cycle that meets a similar functional cycle.

Figure 3:
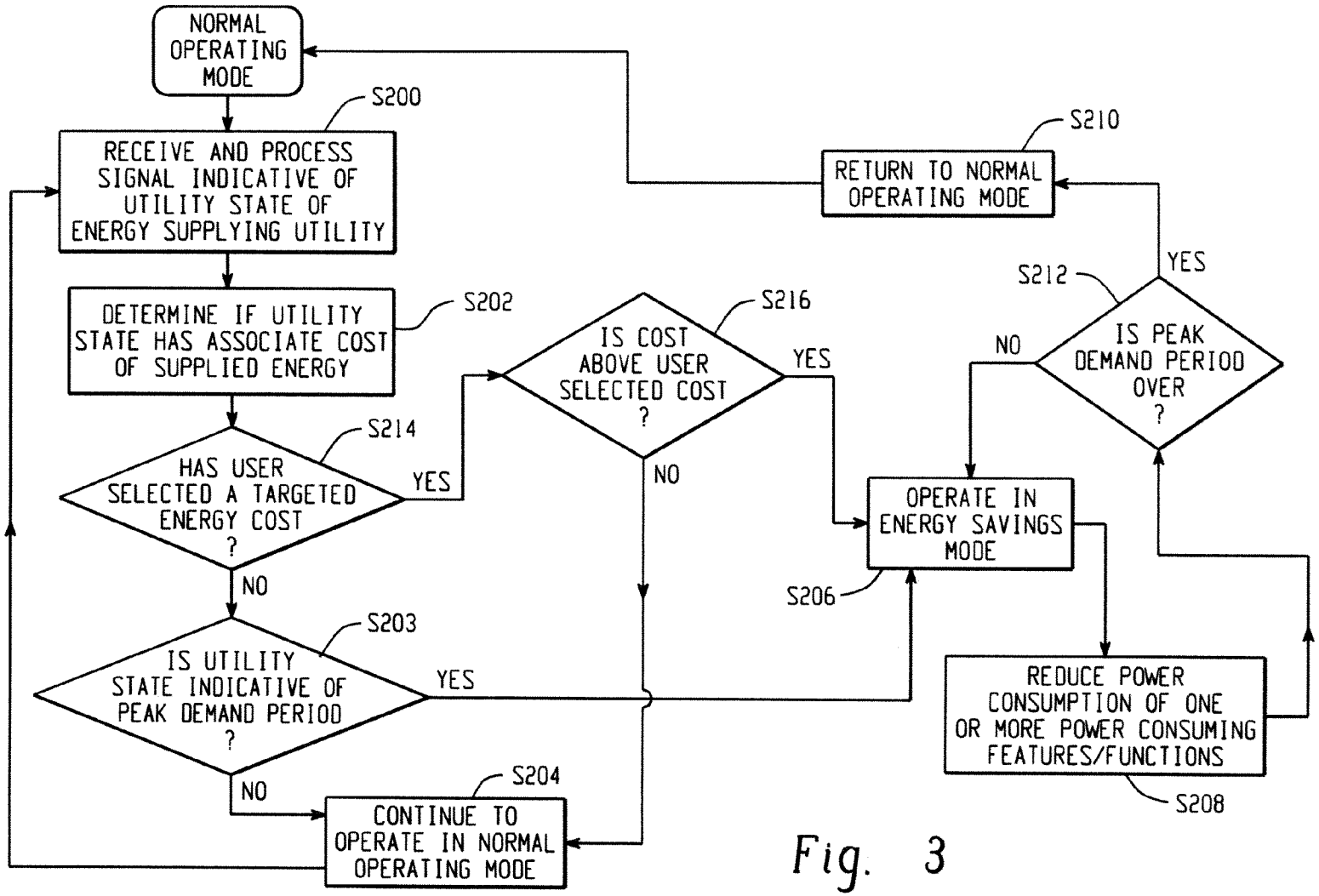
FIG. 3 is a flowchart that generally illustrates the logic associated with a demand managed appliance.

With reference to FIG. 3, a control method in accordance with the present disclosure comprises communicating with an associated utility and receiving and processing the signal indicative of cost of supplied energy (S200), determining a state for an associated energy supplying utility, such as a cost of supplying energy from the associated utility (S202), the utility state being indicative of at least a peak demand period or an off-peak demand period (S203). The method further includes operating the clothes washer 110 in a normal mode during the off-peak demand period (S204), operating the clothes washer 110 in an energy savings mode during the peak demand period (S206), selectively adjusting any number of one or more power consuming features/functions of the clothes washer to reduce power consumption of the appliance in the energy savings mode (S208), and returning to the normal mode (S210) after the peak demand period is over (S212). As further indicated in FIG. 3, the clothes washer can also switch from operating in the normal operating mode to the energy savings mode (S206) when the user has selected a targeted energy cost (S214) and the cost of supplied energy is above the user selected cost (S216).

It is to be appreciated that a selectable override option can be provided on the user interface 116 providing a user the ability to select which of the one or more power consuming features/functions are adjusted by the controller in the energy savings mode. The user can selectively override adjustments, whether time related or function related, to any of the power consuming functions. The operational adjustments, particularly an energy savings operation can be accompanied by a display on the panel which communicates activation of the energy savings mode. The energy savings mode display can include a display of "ECO", "Eco", "EP", "ER", "CP", "CPP", "DR", or "PP" or some other representation on the appliance display 120. In cases with displays having additional characters available, messaging can be enhanced accordingly.

Another load management program offered by an energy supplier may use price tiers which the utility manages dynamically to reflect the total cost of energy delivery to its customers. These tiers provide the customer a relative indicator of the price of energy and in one exemplary embodiment are defined as being LOW (level 1), MEDIUM (level 2), HIGH (level 3), and CRITICAL (level 4). In the illustrative embodiments the appliance control response to the LOW and MEDIUM tiers is the same namely the appliance remains in the normal operating mode. Likewise the response to the HIGH and CRITICAL tiers is the same, namely operating the appliance in the energy saving mode. However, it will be appreciated that the controller could be configured to implement a unique operating mode for each tier which provides a desired balance between compromised performance and cost savings/energy savings. If the utility offers more than two rate/cost conditions, different combinations of energy saving control steps may be programmed to provide satisfactory cost savings/performance tradeoff. The operational and functional adjustments described above, and others, can be initiated and/or dependent upon the tiers. For example, the clothes washer 110 hot water selection can be prevented or 'blocked' from activating if the pricing tier is at level 3 or 4. The display 120 can include an audible and visual alert of pricing tier 3 and 4. Some communication line with the utility can be established including, but not limited to, the communication arrangements hereinbefore described. In addition, the display 120 can provide the actual cost of running the appliance in the selected mode of operation, as well as, maintain a running display of the present cost of energy. If the utility offers more than two rate/cost conditions, different combinations of energy saving control steps may be programmed to provide satisfactory cost savings/performance tradeoff.

Figure 4:
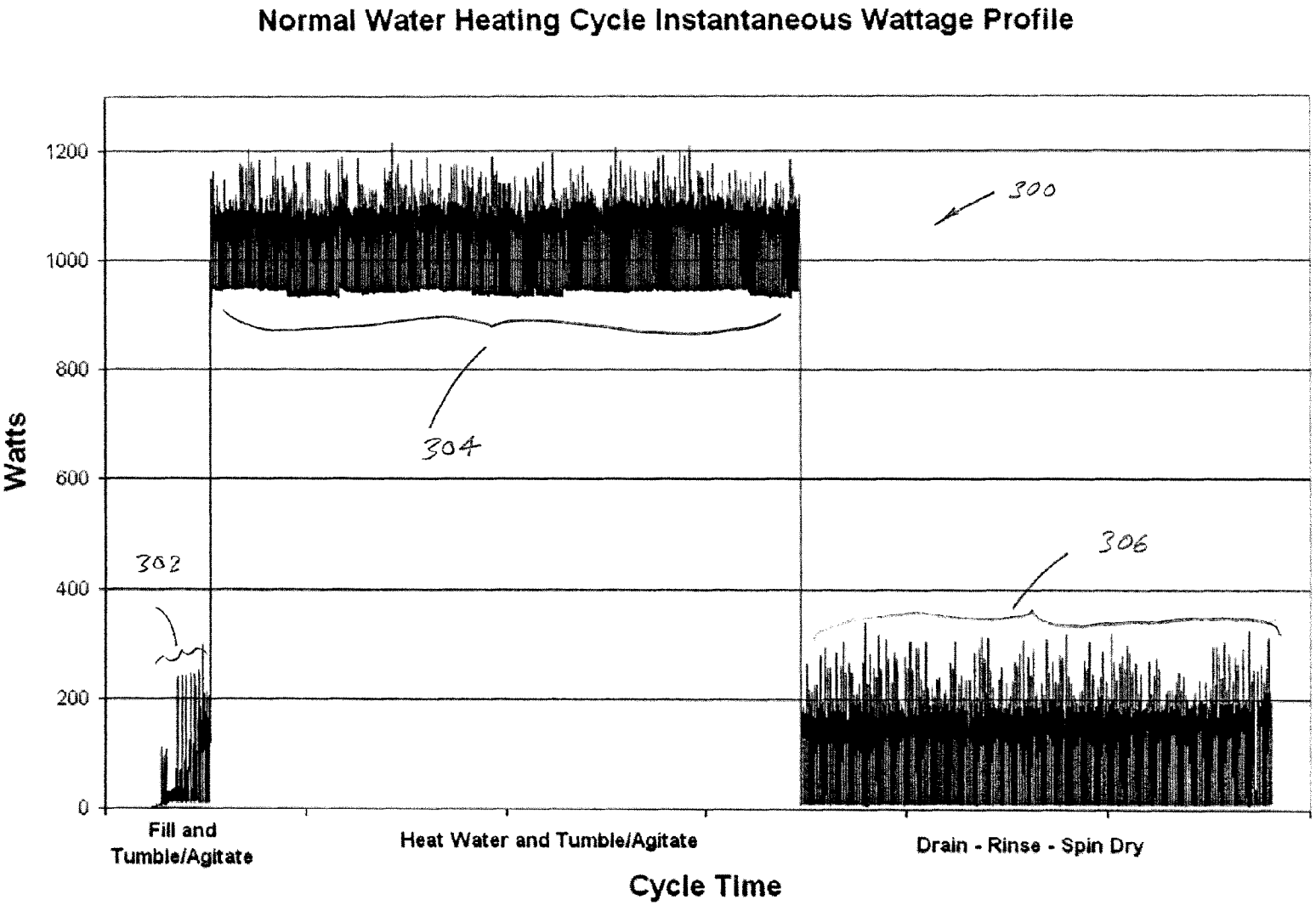
FIG. 4 is a graphical representation of the instantaneous wattage profile for a typical washing machine cycle incorporating a heater.
Figure 5:
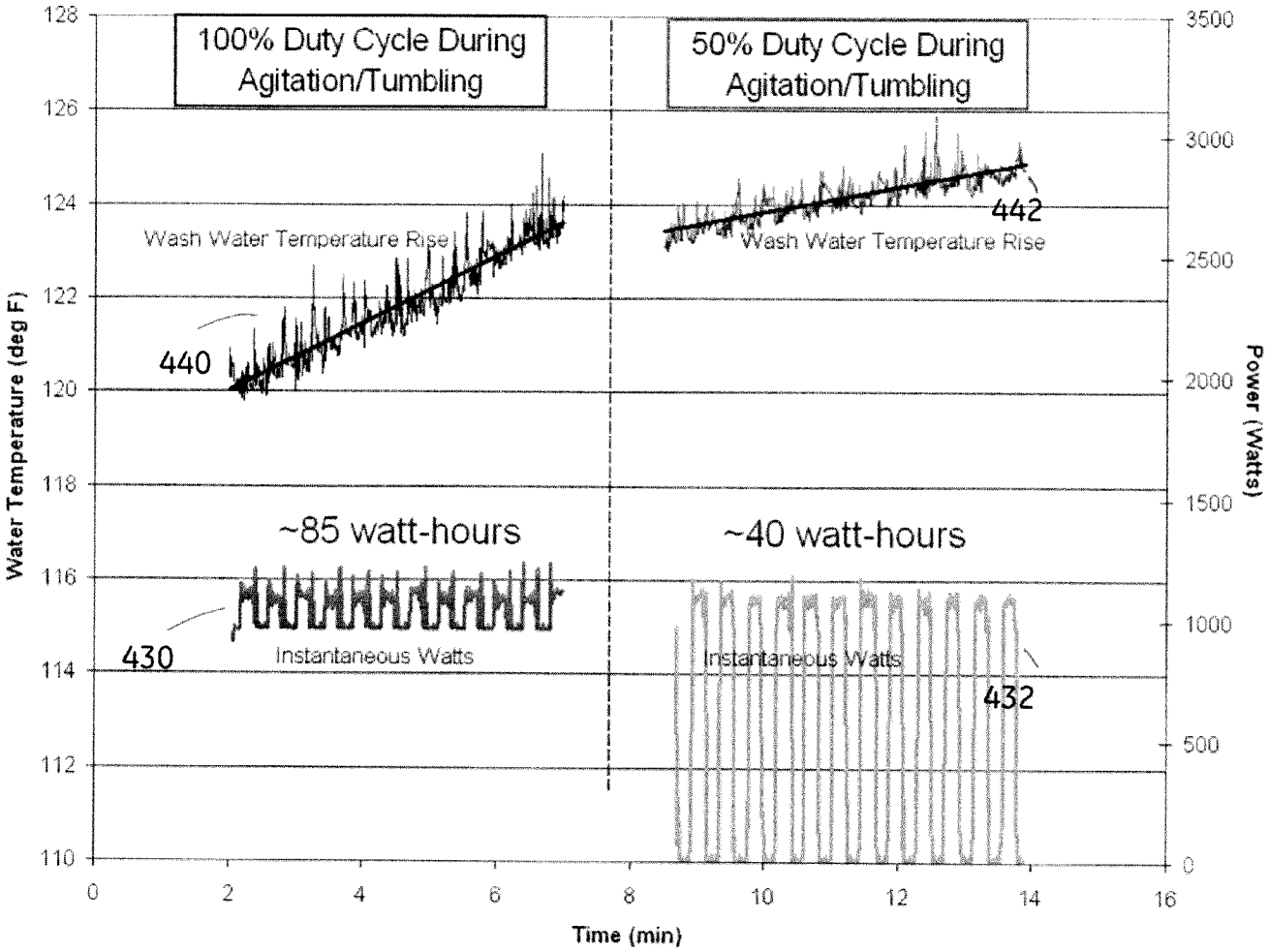
FIG. 5 is a graphical illustration of duty cycling of a heater and its impact on water temperature and average power.

Turning next to FIGS. 4 and 5, some clothes washers are provided with a sanitization or sanitizing cycle in which a heater elevates the water temperature in the clothes washer above 140° F., and preferably to approximately 140°-150° F., for an extended time period, e.g., on the order of 30-60 minutes. This is represented in FIG. 4, where the instantaneous wattage profile 300 of a wash cycle that includes a sanitizing cycle (also generally referred to as water heating) is illustrated. After a fill and tumble/agitate portion 302 of the wash cycle, the water is then heated and then further tumbled/agitated in the sanitizing portion 304 of the wash cycle where energy use in the exemplary embodiment is on the order of 900-1,200 watts. Once the water heating portion 304 of the wash cycle is complete, a remainder 306 of the wash cycle, i.e., drain, rinse, and spin dry, is completed.

As shown in FIG. 4, the most energy intensive portion of the wash cycle is associated with the sterilization or sanitization portion 304. One response in a peak pricing period is to disable the water heating cycle, i.e., not allow the sanitizing portion of the wash cycle to be activated or alternatively delay the wash cycle, although such delay may be on the order of many hours. Although both of these options provide potential cost savings to the user/homeowner, these options are generally viewed as a potential inconvenience. On the other hand, there is an option of allowing the clothes washer to operate in the normal mode, i.e., run the water heating portion of the wash cycle during the peak demand period. As will be appreciated from FIG. 4, however, this has the potential to result in a cost increase for the consumer during a peak demand.

A solution to simultaneously satisfy a desire to save energy and reduce costs while also limiting inconvenience to the homeowner is to intermittently operate or change the duty cycle of the heater 140. That is, the heater operation can be changed by optimizing how frequently the heater is turned on and off during critical or peak demand times in order to reduce the average power usage. Although this would result in a longer cycle, it would help to alleviate the grid and possibly reduce total energy usage during the cycle due to residual unpowered heating effects. Depending on the demand response, e.g., critical, high, medium, etc., multiple duty cycles may be provided to address these various responses. The duty cycle response can be specifically tuned based on the data received from the utility for various critical pricing events. The clothes washer can automatically modify the heating profile to a different duty cycle to reduce average power usage and yet still complete the wash cycle. Again, although the cycle will take longer to maintain the performance attributes of the cycle, this arrangement would allow the cycle to be completed without as much delay as if the cycle were simply paused or deferred until a more economical pricing event occurred. Not only does the consumer or homeowner save money, but this arrangement offers convenience and flexibility to deal with pricing events as communicated by the utility on a real time basis. The cycle can be completed faster while still shedding electrical load and without having to pause or delay the cycle entirely.

As illustrated in FIG. 5, continuously operating the heater 140 (i.e., operating at 100%) results in expending approximately 85 watt-hours over a typical 5 minute period during a washing machine cycle incorporating a heater. On the contrary, duty cycling the heater to operate 50% of the time by intermittently turning the heater on and off results in expending about 40 watt-hours during an equivalent 5-minute period. Wash water temperature increases in a generally linear fashion as shown in plot 440 with regard to constant heater operation while the wash water temperature plot 442 relating to intermittent operation of the heater is also generally linear but at a reduced slope (i.e., more gradual increase over time). This corresponds to the extension of the total cycle length when operating the heater at lower duty cycles. Again, these are simply representative temperature plots and should not otherwise be deemed limiting to the present disclosure.

Duty cycling the heater also has an overall energy benefit as a result of the heater being above the water temperature for a few seconds even when turned off and the heater is still increasing the temperature of the water. It is also contemplated that the heater may cycle between a high state and low state (a reduced wattage level) during the duty cycling, i.e., the heater may not be required to turn "OFF".

In addition, if the DSM signal reduces to a non-high or a non-peak level during the extended heating cycle, the controller 104 can be configured to allow the clothes washer to return to the normal operation mode or could continue with the energy savings mode of operation until the wash cycle is complete. Another advantage provided by the duty cycling option is that the controller 104 can be easily modified by updating the software on the control board of the clothes washer to achieve these energy benefits without altering the physical components of the clothes washer.

Figure 6:
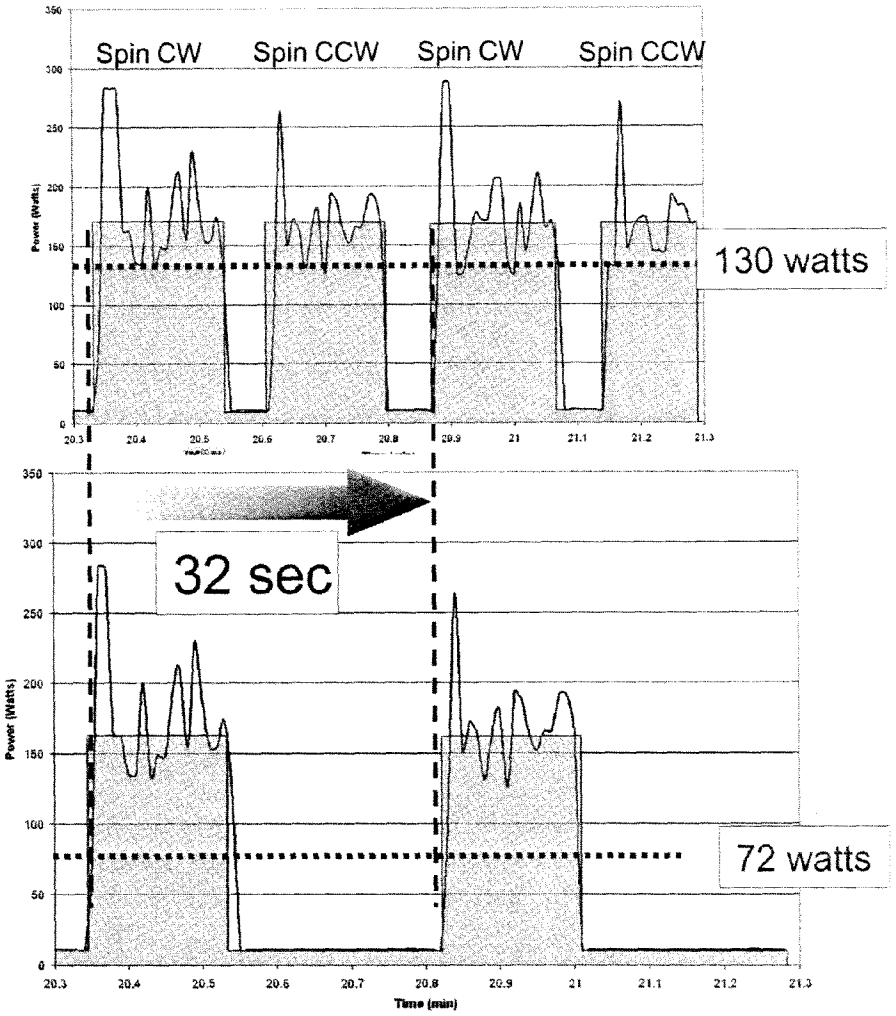
FIG. 6 illustrates energy savings associated with another form of duty cycling the mechanical action FIG. 7 graphically represents one form of duty cycling the mechanical action response.

As shown in FIG. 6, another type of demand response is exemplified. More particularly, the time period between the mechanical action can be altered in the energy savings mode for a significant reduction in average power use (e.g. 130 watts in the normal mode in the upper plot of FIG. 6 and only 72 watts of power used in the lower plot) by increasing the time period between direction reversals in the mechanical action. Note that mechanical action represents movement of a typical basket, drum, agitator, impeller or other similar device intended to move the clothes load inside of a washing machine during operation. For example, in the normal profile of FIG. 6, the spin occurs for about 12 seconds and then the basket coasts for approximately 4 seconds before the next spin operation. In the energy savings mode where the exemplary profile shows a 50% duty cycle, the spin still occurs for about 12 seconds while the time period for coast action is extended to approximately 20 seconds. Over a twenty minute time frame, a reduction of nearly 20 watt-hours can be achieved (referring to FIG. 6). Once again, the referenced numerical values are exemplary only and one skilled in the art will understand that individual energy savings and average power savings may vary depending on whether one or more of these features are used in combination. Total cost savings will likewise vary depending on the associated energy costs charged by the utility and selections by the homeowner whether to adopt one or more of the demand responses for the clothes washer.

Figure 7:
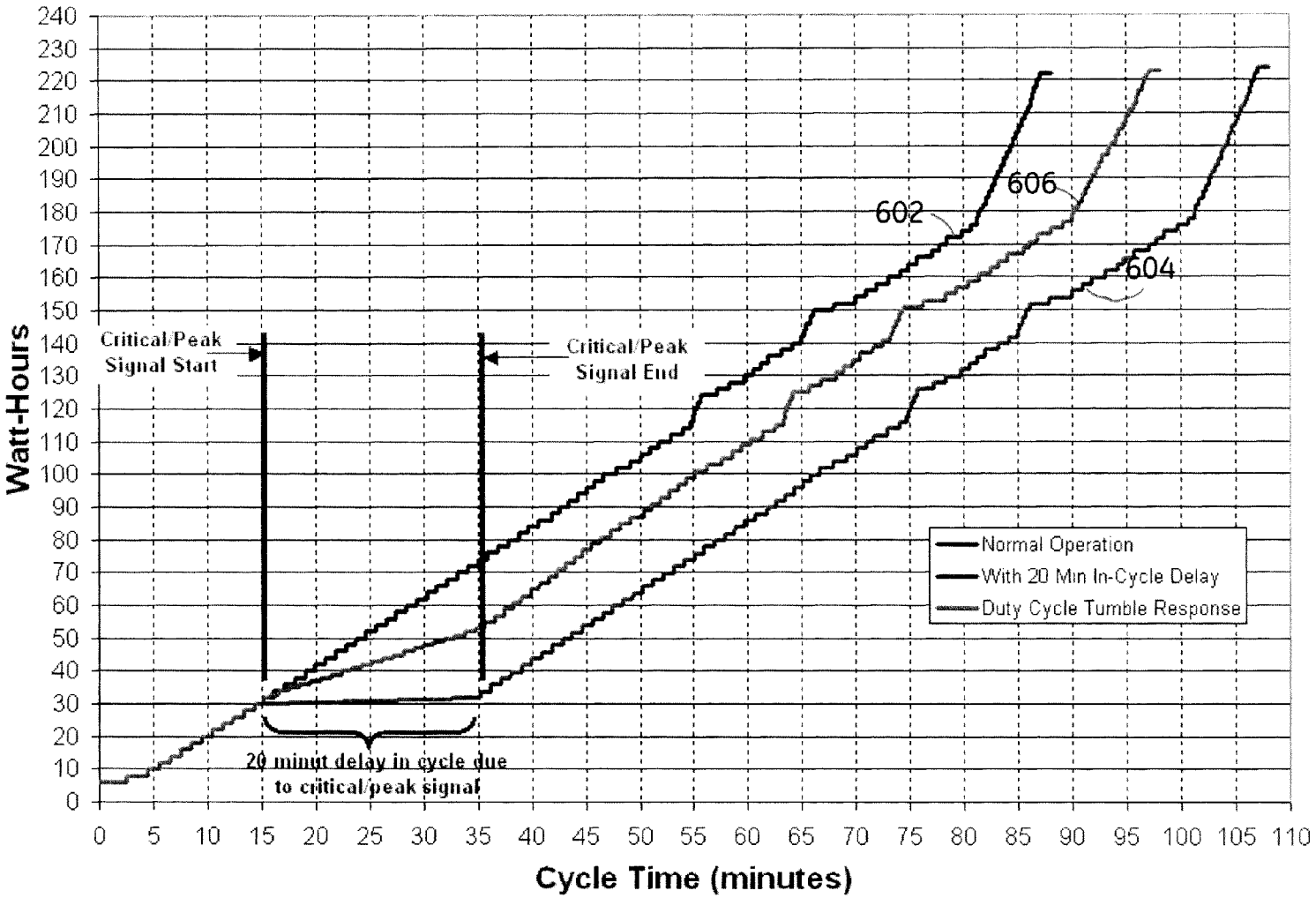

FIG. 7 gives a full cycle view regarding the effects of duty cycling the mechanical action of a washing machine. A normal mode of operation is represented by plot 602 while a twenty minute in-cycle delay response in an energy savings mode is shown by plot 604. Still another demand response to a peak demand period is to duty cycle the mechanical action, i.e., the tumble and/or agitation of the clothes, in an energy savings mode as represented by plot 606. As is evident, the overall cycle time is slightly increased, yet is completed faster than a simple delay (604) and results in no increase in total energy used. Further, time shifting, delaying, or increasing the cycle time enhances the possibility that the peak demand period will expire and operation can return to the normal mode since less expensive energy will become available. The duty cycling of the motor that controls the mechanical action of the basket can be used as a potential demand response or used in conjunction with one or more of the above noted responses (just as any one of the noted responses can be used selectively with one or more of the other responses). Thus, the mechanical action can be modified by, for example, reducing the angular speed of rotation of the mechanical action, increasing the time between direction reversal of the mechanical action, reducing the angular rotation of the mechanical action, increasing the angular rotation of the mechanical action, and/or duty cycling the mechanical action. It is also contemplated that the amount of change in the mechanical action can be made dependent on the level of the signal received.

The disclosure has been described with reference to the preferred embodiments. Obviously, modifications and alterations will occur to others upon reading and understanding the preceding detailed description. It is intended that the invention be construed as including all such modifications and alterations.

What is claimed is:

1. A clothes washer comprising:

at least two power consuming features including a heater assembly configured to heat water used by the clothes washer and a drive system configured to effectuate mechanical action on a device intended to move a load of clothes disposed inside the clothes washer;

a controller configured to receive and process a signal indicative of the cost of supplied energy and, based on the received signal, is further configured to operate the clothes washer in one of a plurality of operating modes including at least a normal mode where the drive system is configured to operate over a first total cycle time and consume a first amount of energy, and an energy savings mode where drive system is configured to duty cycle so as to operate over a second total cycle time greater than the first total cycle time and consume a second amount of energy less than or equal to the first amount of energy;

wherein when the cost of supplied energy is above a user selected targeted energy cost, the controller is configured to operate the clothes washer in the energy savings mode.

2. The clothes washer of claim 1 wherein in the energy savings mode operation of the drive system is further modified by at least one of reducing an angular speed of rotation of a mechanical action effectuated by the drive system, altering a time between direction reversal of a mechanical action effectuated by the drive system, and altering an angular rotation of a mechanical action effectuated by the drive system.

3. The clothes washer of claim 2 wherein in the energy savings mode the amount of change of the at least one mechanical action effectuated by the drive system is dependent on the level of signal received.

4. The clothes washer of claim 1 wherein in the energy savings mode drive system is configured to operate intermittently to generate intermittent mechanical actions with equal time delays or pauses between subsequent mechanical actions.

5. The clothes washer of claim 1 wherein in the energy savings mode the heater assembly is duty cycled to reduce the average power used by the heater assembly.

6. The clothes washer of claim 5 wherein the heater assembly is intermittently turned on and off so that subsequent on periods and off period are equal.

7. The clothes washer of claim 5 wherein in the energy savings mode an amount of change of an average power of the heater assembly is dependent on the level or duration of the signal received.

8. The clothes washer of claim 1 wherein in the heater assembly is operatively associated with a water heating cycle and the drive system is operatively associated with at least one of a wash cycle, a rinse cycle and a spin cycle.

9. A clothes washer comprising:

a housing;

a tub or basket dimensioned to receive laundry items therein;

a drive system received in the housing configured to effectuate mechanical action to the tub or basket;

an inlet adapted to selectively provide water to the tub or basket;

an outlet adapted to selectively drain water from the tub or basket;

a heater assembly for heating water supplied through the inlet; and a controller operatively associated with the tub or basket, inlet, outlet, and heater assembly for controlling operation of the clothes washer through various operating cycles, the controller configured to receive and process a signal indicative of the cost of supplied energy and, based on the received signal, is further configured to operate the clothes washer in one of a plurality of operating modes including at least a normal mode where the drive system is configured to operate over a first total cycle time and consume a first amount of energy and an energy savings mode where the drive system is configured to duty cycle so as to operate over a second total cycle time greater than the first total cycle time and consume a second amount of energy less than or equal to the first amount of energy;

wherein when the cost of supplied energy is above a user selected targeted energy cost, the controller is configured to operate the clothes washer in the energy savings mode.

10. The clothes washer of claim 9 wherein in the energy savings mode operation of the drive system is further modified by at least one of reducing an angular speed of rotation of a mechanical action effectuated by the drive system, altering a time between direction reversal of a mechanical action effectuated by the drive system, and altering an angular rotation of a mechanical action effectuated by the drive system.

11. The clothes washer of claim 10 wherein in the energy savings mode the amount of change of the at least one mechanical action effectuated by the drive system is dependent on the level of signal received.

12. The clothes washer of claim 9 wherein in the energy savings mode the drive system is configured to operate intermittently to generate intermittent mechanical actions with equal time delays or pauses between subsequent mechanical actions.

13. The clothes washer of claim 9 wherein in the energy savings mode the heater assembly is duty cycled to reduce the average power used by the heater assembly.

14. The clothes washer of claim 13 wherein the heater assembly is intermittently turned on and off so that subsequent on periods and off period are equal.

15. The clothes washer of claim 13 wherein in the energy savings mode an amount of change of an average power of the heater assembly is dependent on the level or duration of the signal received.

16. The clothes washer of claim 9 wherein in the heater assembly is operatively associated with a water heating cycle and the drive system is operatively associated with at least one of a wash cycle, a rinse cycle and a spin cycle.

* * * * *